US006949703B2

(12) United States Patent
Heubeck

(10) Patent No.: US 6,949,703 B2
(45) Date of Patent: Sep. 27, 2005

(54) CONGA STAND

(75) Inventor: Udo Heubeck, Diespeck (DE)

(73) Assignee: Roland Meini Muskinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 10/778,042

(22) Filed: Feb. 17, 2004

(65) Prior Publication Data

US 2004/0159210 A1 Aug. 19, 2004

(30) Foreign Application Priority Data

Feb. 15, 2003 (DE) ..... 203 02 476 U

(51) Int. Cl.[7] ..... G10D 13/02
(52) U.S. Cl. ..... 84/421
(58) Field of Search ..... 84/421, 327, 419, 84/420, 422.1, 422.2, 422.3

(56) References Cited

U.S. PATENT DOCUMENTS 6,091,011 A * 7/2000 Simons et al. ..... 84/421
6,541,685 B2 * 4/2003 Meinl ..... 84/421

* cited by examiner

*Primary Examiner*—Kimberly Lockett
(74) *Attorney, Agent, or Firm*—Browdy and Neimark, P.L.L.C.

(57) ABSTRACT

A conga stand comprises legs with joined-on holding pieces for insertion of a conga; a holding ring, on which the legs are mounted and which has lateral edges; an aperture in each leg for it to be fixed to the holding ring; apertures in the holding ring for the legs to be fixed to the holding ring; and fixing screws, which pass through the apertures of the holding ring and the leg, each fixing screw having a nut for the legs to be fixed to the holding ring. With a view to simple assembly and disassembly of the conga stand accompanied with excellent stableness on the ground and the possibility of use for congas of varying size, it is provided that the apertures of the holding ring are open towards the lateral edges thereof for insertion of the fixing screws from a lateral edge of the holding ring.

11 Claims, 1 Drawing Sheet

CONGA STAND

BACKGROUND OF THE INVENTION

1. Field of the Invention

The invention relates to a conga stand, comprising legs with joined-on holding pieces for insertion of a conga; a holding ring on which the legs are mounted and which has lateral edges; an aperture in each leg for it to be fixed to the holding ring; apertures in the holding ring for fixing the legs to the holding ring; and fixing screws which pass through the holding-ring and leg apertures that align in pairs, each fixing screw having a respective nut for fixing the legs to the holding ring.

2. Background Art

Conga stands of the generic type are used in particular for congas of some size, which cannot be held between a player's legs. Conga stands come in numerous and varying designs, with comparatively complicated embodiments resulting from the desire to make one and the same conga stand suitable for congas of the most varying dimensions.

As a result of the complexity of some prior art constructions, these conga stands will be comparatively expensive, and quite a few musicians do not even make use of the all-purpose character of the known constructions, it being their wish to use a certain stand only for a certain conga.

Conga stands of the generic type are known for example from DE 295 00 540 U1 and U.S. Pat. No. 6,541,685. They have been extraordinarily successful in practice. A certain drawback resides in that fastening the legs to the holding ring and detaching them there-from is accompanied with some mounting requirements.

SUMMARY OF THE INVENTION

It is an object of the invention to improve a conga stand of the type mentioned at the outset in such a way that assembling/disassembling the conga stand is distinctly simplified, accompanied with excellent stableness on the ground, and that the stand can be used for congas of varying size.

According to the invention, this object is attained by the apertures of the holding ring being open towards the lateral edges thereof for insertion of the fixing screws from a lateral edge of the holding ring. This design ensures that the screwed connections only have to be loosened slightly upon disassembly of the conga stand. Complete disconnection of the screwings is not necessary as a result of the apertures of the holding ring being open towards the lateral edges thereof, which considerably simplifies the disassembly as well as assembly of the legs.

Suitably, the apertures of the holding ring have the shape of a U. This can be manufactured at a low cost, enabling the fixing screws to be inserted and removed without any problems.

Preferably, the apertures of the holding ring are open towards the bottom lateral edge. Upon assembly of the legs, the fixing screws can be inserted from the bottom lateral edge into the holding-ring apertures so that, upon assembly, the holding ring rests directly on the fixing screws. Consequently, it is not absolutely necessary to retain the holding ring when the nuts are tightened.

Another constructional feature resides in that each leg has alignment ribs which encompass the holding ring. The alignment ribs provide for accurate and uniform alignment of the legs relative to the holding ring. Lop-sided mounting of the legs on the holding ring is precluded by the alignment ribs.

For modification of the distance of the joined-on holding pieces, provision is preferably made for a spacer block which can be slipped on the fixing screws between the leg and holding ring. This design enables one and the same conga stand to be used for congas of varying dimensions.

In keeping with an advantageous embodiment, each spacer block comprises two alignment ribs that project and are parallel to each other, encompassing the holding ring. The alignment ribs provide for accurate alignment of the spacer blocks in relation to the holding ring. Furthermore, this helps create a stable connection between the spacer block and the holding ring.

Suitably, each spacer block has two parallel alignment recesses for engagement with the alignment ribs of the leg. Accurate alignment of the spacer blocks relative to the legs is a result of this design. Moreover, excellent stableness of the conga stand is attained.

Preferably, the spacer blocks have respective apertures of circular cross-sectional shape for being slipped onto a fixing screw.

By advantage, the fixing screws have a safeguard against loss of the nuts. In this case, the spacer blocks preferably have groove-type apertures which are laterally open for sidewise insertion of the fixing screws. By advantage, the spacer block apertures have the shape of a U. The screws and the respective nuts are thus captivated on the holding ring. As a result of the spacer-block aperture being laterally open, the spacer blocks may be inserted and removed as desired, or they can be replaced by spacer blocks for other congas.

Details of the invention will become apparent from the ensuing description of a preferred embodiment, taken in conjunction with the drawing.

DESCRIPTION OF A PREFERRED EMBODIMENT

Figure 1:
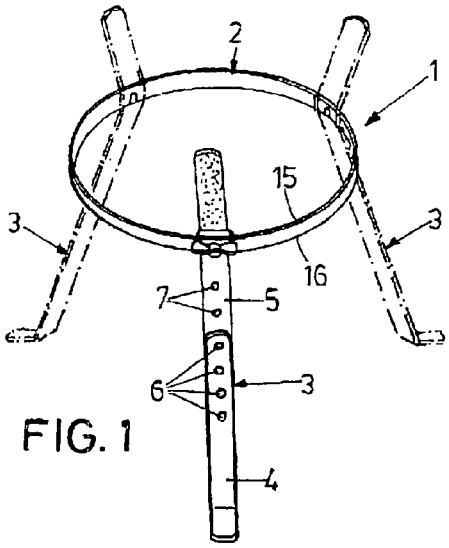
FIG. 1 is a perspective view of a conga stand according to the invention.

A conga stand 1 seen in FIG. 1 comprises a holding ring 2 on which three legs 3 are mounted.

Each leg 3 comprises a bottom section 4 and a top section 5 which are bent in a direction perpendicular to their longitudinal extension, having the same radius of curvature so that they can be fitted together, overlapping telescopically. The top and the bottom section 5 and 4 have a series of equidistant drilled holes 6 and 7; the drilled hole 7 of the top section 5 which, in use, is the underlying section has an internal thread 8 and the drilled hole 6 of the bottom section which, in use, lies on top has a conical section for accommodation of the head of a screw (not shown), the thread portion of which can be screwed into the internal thread of the drilled hole 7.

By telescoping displacement of the sections 4 and 5 one relative to the other, the height of each leg 3 can be regulated, the at least two drilled holes 6 and 7 being movable to coincide so that a position thus adjusted can be fixed by means of two screws. The insertion of the screws and the curvature of the sections 4 and 5 help obtain a stable, non-warping construction.

The top section 5 of each leg 3 comprises two alignment ribs 8 which are parallel to each other and spaced apart, encompassing the holding ring 2 from inside. The alignment ribs 8 are integrally joined to the respective legs 3.

Between the alignment ribs 8 that are molded on a leg 3, each leg 3 is centrally provided with an aperture 9 which is in alignment with an aperture 10 in the holding ring 2 so that a fixing screw 11 can be pushed through from inside the holding ring 2 until the head 12 of the fixing screw 11 bears against the inside of the leg 3, with a shim 13 and a fly nut 14 being placed or screwed from outside on the fixing screw 11. The leg apertures 9 are circular cross-sectionally, whereas the holding-ring apertures 10 have the shape of a U. The holding ring 2 has a top lateral edge 15 and a bottom lateral edge 16, with the apertures 10 being open towards the bottom lateral edge 16. The width of the holding-ring apertures 10 is selected for the fixing screws 11 to be inserted and removed laterally without any problems. The holding-ring aperture 10 has a depth T and a width W, while the holding ring 2 has a height H. $0.3 \leqq W/T \leqq 0.7$, in particular $0.4 \leqq W/T \leqq 0.6$, applies to the dimensions-W-to-H ratio. $0.4 \leqq T/H \leqq 0.9$, in particular $0.6 \leqq T/H \leqq 0.8$, applies to the dimensions-T-to-H ratio. Tightening the fly nuts 14 provides for the legs 3 to be stably fixed to the holding ring 2.

The top section 5 of each leg 3 has a joined-on holding piece 17 with a bearing pad 18; the legs 3 extend from the holding ring 2 externally downwards and the joined-on holding pieces 17 extend externally upwards so that a hopper-type area is created into which to insert the conga, where it is then retained by clamping frictional engagement.

Each leg 3 has a cranked section at its lower end; the cranked section extends outwards and can be provided with a rubber cushion.

In the vicinity of the pilot, the fixing screws 11 may have a safeguard 19 against loss of the fly nuts 14. The safeguard 19 prevents the fly nuts 14 from being screwed off the screws 11. Losing the fly nuts 14 or the fixing screws 11 is not possible.

For detachment of the legs 3 from the holding ring 2, the fly nut 14 only has to be screwed off sufficiently far for the holding ring 2 to be disengaged from the alignment ribs 8 of the leg 3.

Figure 3:
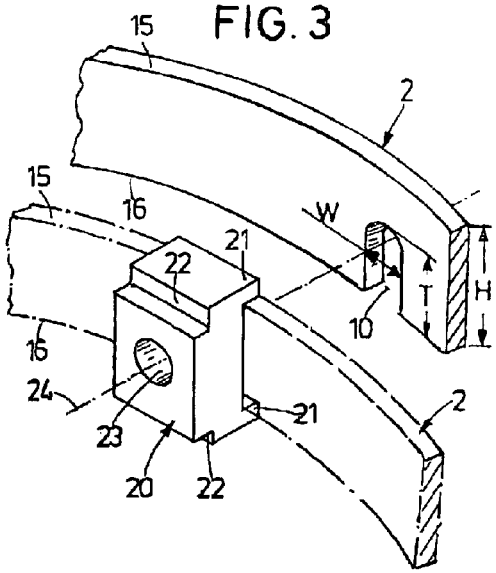
FIG. 3 is a perspective view of a spacer block connected to the holding ring.
Figure 2:
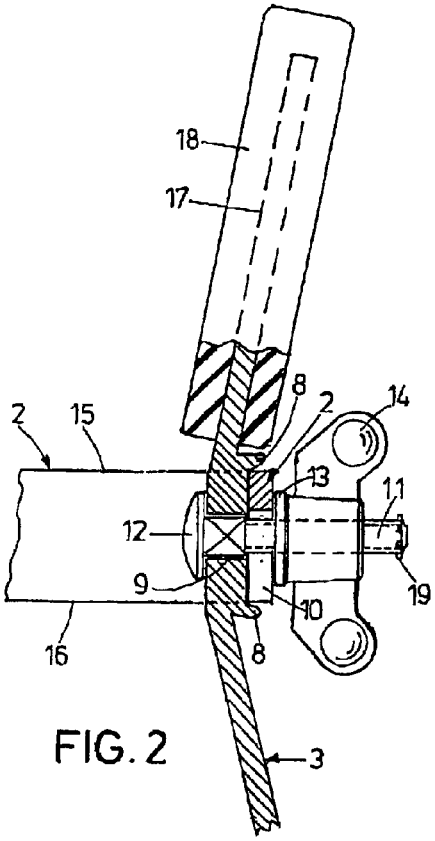
FIG. 2 is a sectional view of a leg mounted on a holding ring.
Figure 4:
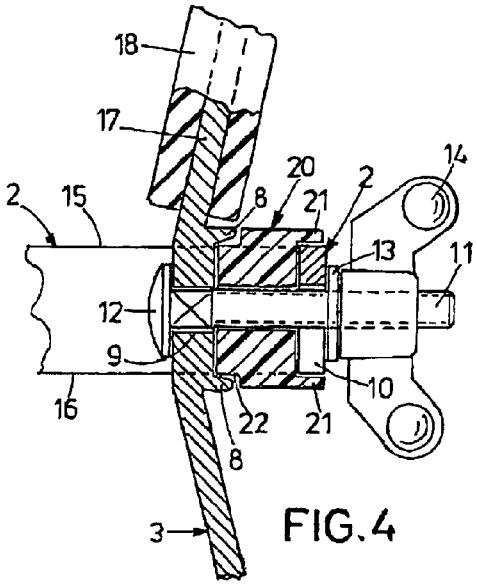
FIG. 4 is a sectional view of a leg that is mounted on the holding ring, the spacer block seen in FIG. 3 being disposed between the leg and the holding ring.

The following is a description of an advantageous improvement of the invention, taken in conjunction with FIGS. 3 and 4. Identical parts have the same reference numerals as in the above exemplary embodiment, to the description of which reference is made.

The improvement illustrated in FIGS. 3 and 4 only distinguishes itself by the fact that a spacer block 20 is slipped on the fixing screws 11 in between the legs 3 and the holding ring 2. The spacer block 20 has two projecting alignment ribs 21 which are parallel to each other and spaced apart, encompassing the holding ring 2. On the side of the spacer block 20 that faces away from the holding ring 2, two alignment recesses 22 are formed, which are parallel to each other and spaced apart. The alignment ribs 21 and the alignment recesses 22 extend in one direction. As seen in FIG. 4, the alignment ribs 8 of the leg 3 engage with the alignment recesses 22 of a spacer block 20. The spacer blocks 20 may be embodied such that several spacer blocks 20 can be arranged one after the other on a fixing screw 11.

For being slipped on the fixing screws 11, the spacer blocks 20 are provided with a central aperture 23 of circular cross-sectional shape. The central axis 24 of the spacer-block aperture 23 is perpendicular to the longitudinal extension of the alignment ribs 21. In this case, the fixing screws 11 do not have a safeguard against loss 19 for placement and removal of the spacer blocks 20 to be possible.

For removal of the legs 3 from the holding ring 2, the fly nut 14 only has to be screwed off sufficiently far for the holding ring 2 to be disengaged from the alignment ribs 21 of the spacer blocks 20.

By alternative of the cross-sectionally circular spacer-block aperture 23, provision can be made for a laterally open, groove-type aperture in the shape of a U. This laterally open spacer-block aperture enables the fixing screws 11 to be inserted sidewise. In this embodiment, the spacer blocks can be inserted or removed even when the fixing screws have a safeguard against loss.

For removal of the spacer block that is arranged between a leg 3 and the holding ring 2, only the fly nut 14 must be screwed off sufficiently far for the spacer block 20 to be disengaged from the alignment ribs 8 of the leg 3 and from the holding ring 2.

What is claimed is:

1. A conga stand, comprising legs (3) with joined-on holding pieces (17) for insertion of a conga;

a holding ring (2), on which the legs (3) are mounted and which has lateral edges (15, 16);

an aperture (9) in each leg (3) for it to be fixed to the holding ring (2);

apertures (10) in the holding ring (2) for the legs (3) to be fixed to the holding ring (2); and fixing screws (11), which pass through the holding-ring and leg apertures (9, 10), each fixing screw (11) having a nut (14) for the legs (3) to be fixed to the holding ring (2);

wherein the holding-ring apertures (10) are laterally open for insertion of the fixing screws (11) from a lateral edge (15, 16) of the holding ring (2).

2. A conga stand according to claim 1, wherein the apertures (10) have the shape of a U.

3. A conga stand according to claim 1, wherein the apertures (10) of the holding ring (2) are open towards the bottom lateral edge (16) thereof.

4. A conga stand according to claim 1, wherein each leg (3) has alignment ribs (8) that encompass the holding ring (2).

5. A conga stand according to claim 1, comprising a spacer block (20) which is installable on the fixing screws (11) between the leg (3) and the holding ring (2) for modification of the distance of the joined-on holding pieces (17) from each other.

6. A conga stand according to claim 5, wherein each spacer block (20) comprises two alignment ribs (21) which project and are parallel to each other, encompassing the holding ring (2).

7. A conga stand according to claim 5, wherein each spacer block (20) comprises two alignment recesses (22), which are parallel to each other, for engagement with the alignment ribs (8) of the leg (3).

8. A conga stand according to claim 5, wherein each spacer block (20) has a cross-sectionally circular aperture (23) for being slipped onto a fixing screw (11).

9. A conga stand according to claim 5, wherein each spacer block has a laterally open, groove-type aperture for lateral insertion of the fixing screws (11).

10. A conga stand according to claim 9, wherein the spacer-block apertures have the shape of a U.

11. A conga stand according to claim 9, wherein each fixing screw (11) has a safeguard (9) against loss of the nuts (14).

* * * * *

UNITED STATES PATENT AND TRADEMARK OFFICE

CERTIFICATE OF CORRECTION

PATENT NO. : 6,949,703 B2
APPLICATION NO. : 10/778042
DATED : September 27, 2005
INVENTOR(S) : Udo Heubeck It is certified that error appears in the above-identified patent and that said Letters Patent is hereby corrected as shown below:

On Title Page, Item (73) Col. 1 the Assignee name should read --Roland Meinl Musikinstrumente GmbH & Co. KG--.

Signed and Sealed this

Fifth Day of September, 2006

JON W. DUDAS
*Director of the United States Patent and Trademark Office*